United States Patent [19]

Wilson

[11] 4,120,259

[45] Oct. 17, 1978

[54] VISUAL AND RADAR EMERGENCY DETECTION BALLOON

[75] Inventor: Gene W. Wilson, Enterprise, Oreg.

[73] Assignee: The Raymond Lee Organization, Inc., New York, N.Y.

[21] Appl. No.: 771,079

[22] Filed: Feb. 23, 1977

[51] Int. Cl.[2] ..... G08B 21/00; H01Q 15/18

[52] U.S. Cl. ..... 116/124 B; 343/18 B

[58] Field of Search ..... 116/124 B, DIG. 9; 40/214, 212; 343/18 B; 46/87, 88

[56] References Cited

U.S. PATENT DOCUMENTS

| | | | |
|---|---|---|---|
| 1,858,460 | 5/1932 | Ranseen | 40/214 X |
| 2,722,775 | 11/1955 | Rinker, Jr. | 46/88 |
| 2,831,967 | 4/1958 | Bayze | 116/124 B X |
| 3,721,983 | 3/1973 | Sherer | 116/124 B X |
| 3,941,079 | 3/1976 | McNeill | 116/124 B |

FOREIGN PATENT DOCUMENTS

| | | | |
|---|---|---|---|
| 658,710 | 3/1963 | Canada | 116/124 B |
| 343,518 | 9/1936 | Italy | 40/214 |
| 65,444 | 8/1913 | Switzerland | 40/212 |
| 13,534 of | 1899 | United Kingdom | 40/214 |

*Primary Examiner*—Daniel M. Yasich
*Attorney, Agent, or Firm*—Howard I. Podell

[57] ABSTRACT

A kit containing an inflatable balloon, a length of tethering cord attached to a balloon harness and a container of gas for inflating the balloon. The harness is formed of four shaped flat cards, each joined by a flat elastic band to a cross-piece bracket, with a cord extending from each card to the tethering cord. When the balloon is inflated, with the cross-piece bracket externally mounted about the top of the balloon, each elastic band extends to a card mounted about a lower quadrant of the balloon, with each card held in a plane substantially perpendicular to the two adjacent cards. The balloon and cards are externally covered with a coating that reflects both light and radar waves. The elasticity of the bands enables the balloon to uniformly expand as it rises, and the cards serve to extend the plane of visual and radar reflection.

1 Claim, 3 Drawing Figures

VISUAL AND RADAR EMERGENCY DETECTION BALLOON

SUMMARY OF THE INVENTION

My invention is a kit containing an inflatable balloon, a length of tethering cord attached to a ballon harness and a container of gas for inflating the balloon. The harness is formed of four shaped flat cards, each joined by a flat elastic hand to a cross-piece bracket, with a cord extending from each card to the tethering cord. When the balloon is inflated, with the cross-piece bracket externally mounted about the top of the balloon, each elastic band extends to a card mounted about a lower quadrant of the balloon, with each card held in a plane substantially perpendicular to the two adjacent cards. The balloon and cards aer externally covered with a coating that reflects both light and radar waves. The elasticity of the band enables the balloon to uniformly expand as it rises, and the cards serve to extend the plane of visual and radar reflection.

BRIEF DESCRIPTION OF THE DRWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
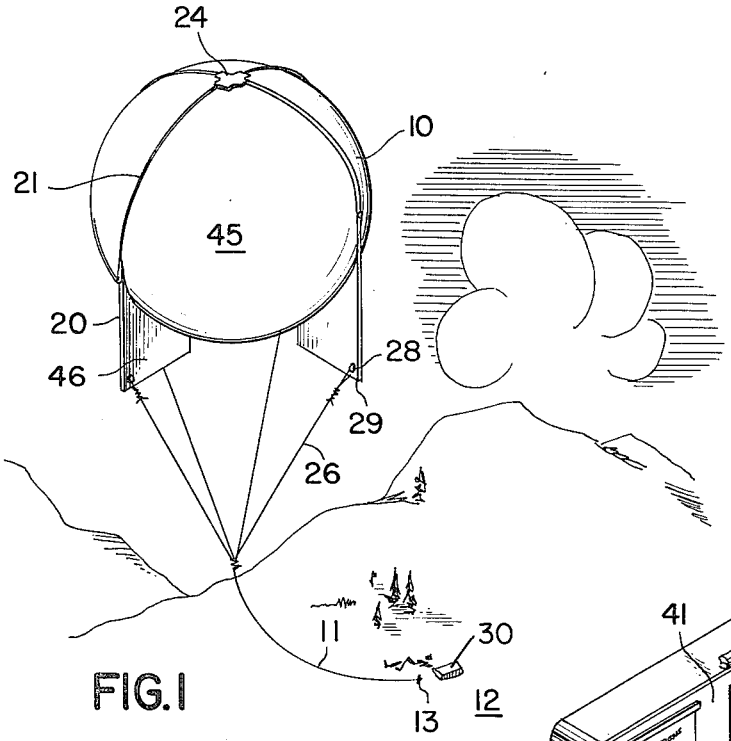
FIG. 1 is a perspective view of the invention, in use.
Figure 2:
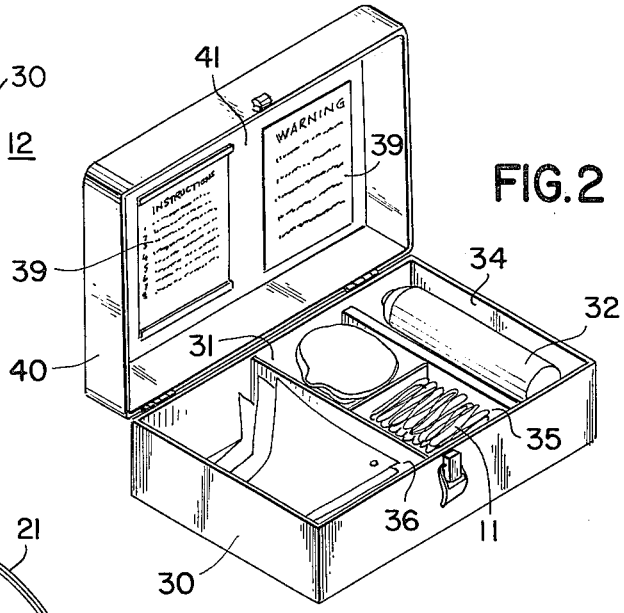
FIG. 2 is a perspective view of the kit of the invention.
Figure 3:
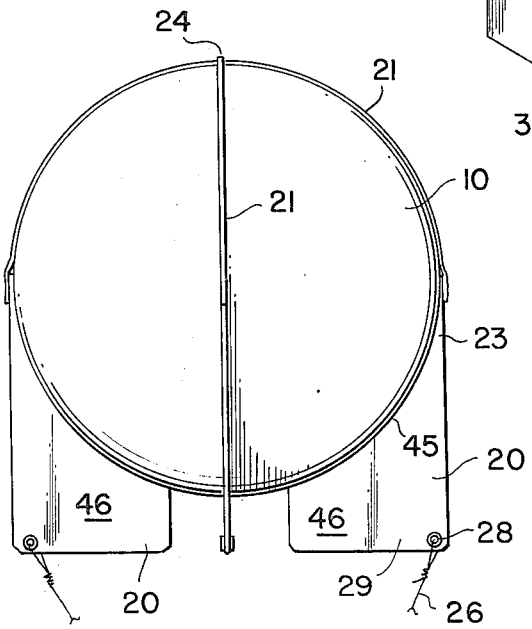
FIG. 3 is a side view of the balloon and reflector cards.

Turning now descriptively to the drawings, in which similar reference characters denote similar elements throughout the several views, FIGS. 1–2 illustrate the Emergency balloon 10 which may be tethered by a flexible cord 11 to provide a visual and radar target to signal an emergency situation at the site 12 from which the balloon is tethered by cord 11 to a stake 13.

Balloon 10 is of a conventional inflatable spherical shape and the outer surface 45 of the balloon and the external surface 46 of the attached target cards 20, are coated with a light and radar reflecting material.

Target cards 20 are each mounted to a lower quadrant of the balloon by a flexible strap 21, with each card 20 oriented along a radial plane of the balloon, with each strap 21 extending from the top corner section 23 of a card 20 to a cross-piece 24 mounted on the top of the balloon. Straps 21 are of elastic material to permit the circumference of the balloon to expand as the balloon is inflated as the balloon expands in flight.

Cards 20 are made of light weight sheet material and increase the area of reflectivity of the assembly to light and radar rays.

A cord 26 is fastened through a hole 28 in the lower external corner section 29 of each card 20, with the cords 26 joined together and to the tether cord 11.

As shown in FIG. 2, the deflated balloon may be carried in a compartment 31 of a container 30, with a tank of helium gas 32, a quantity of tether cord 11 and the set of the detached target cards 20 each stored in individual compartments 34–36 respectively. Instruction information may be fixed on cards 39 mounted to the inside face 41 of the hinged cover 40 of the container 30.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A balloon which may be tethered by a flexible cord to provide a visual and a radar target to signal an emergency situation at a site from which the balloon is tethered, in which said balloon is fitted with radar and light reflecting projecting cards that extend away from the balloon to increase the area of reflectivity of the balloon and sheets to light and radar rays, comprising a balloon inflated with a gas such as helium so as to cause it to rise in air, an elastic strap means fitted over the top of the balloon which expands so as to permit the circumference of the balloon to expand as the balloon expands in flight, said strap means formed of a plurality of leg section, each said leg section being joised to a common cross-piece above the top of the balloon, with each strap leg section extending from the cross-piece and about the top section of the balloon to join to individual cards of said projecting cards, the individual cards flat and extending below the lower section of the balloon, with each flat card fastened to an individual tie cord, with all said tie cords tied together below the balloon at a common point to the common tether cord so as to retain each said card abutting a lower quadrant of the balloon, with each said card extending in a substantially vertical plane below the balloon in a radial plane relative to the balloon, said cards aligned by the elastic strap and the tie cords so that at least two such cards extend in substantially mutually perpendicular vertical planes, in which the external surface of said balloon and each said card is coated with a layer of light and radar reflective material, and in which the cards serve to extend the plane of visual and radar reflection area of the balloon.

* * * * *